United States Patent [19]

Press

[11] Patent Number: 4,763,896

[45] Date of Patent: Aug. 16, 1988

[54] HAND EXERCISER

[76] Inventor: Fred Press, 242 Lantern Rd., Apt. 23, Revere, Mass. 02151

[21] Appl. No.: 21,623

[22] Filed: Mar. 2, 1987

Related U.S. Application Data

[63] Continuation of Ser. No. 766,889, Aug. 16, 1985, abandoned.

[51] Int. Cl.[4] ..... A63B 21/30

[52] U.S. Cl. ..... 272/68; 272/137

[58] Field of Search ..... 272/67, 68, 93, 135, 272/137; 73/379–381

[56] References Cited

U.S. PATENT DOCUMENTS

| | | | |
|---|---|---|---|
| 1,472,906 | 11/1923 | Gorrell | 272/68 |
| 3,103,213 | 9/1963 | Robinson | 272/68 |
| 3,349,621 | 10/1967 | Mullen | 272/68 |
| 3,612,521 | 10/1971 | Wendelborn | 272/68 |
| 4,105,200 | 8/1978 | Unger | 272/68 |
| 4,262,898 | 4/1981 | Lee | 272/68 |
| 4,455,019 | 6/1984 | Harris | 272/68 |

FOREIGN PATENT DOCUMENTS

| | | | |
|---|---|---|---|
| 245458 | 2/1926 | Italy | 272/68 |

*Primary Examiner*—Richard J. Apley
*Assistant Examiner*—J. Welsh
*Attorney, Agent, or Firm*—Felfe & Lynch

[57] ABSTRACT

A hand exerciser has a pair of generally-parallel handles pivoted at corresponding ends. A spring urges the handles together, but a slotted plate engaging end portions of the spring keep the handles spaced apart for receiving the hand therebetween. Projections between the handles intermediate their ends position the thumb and one or more fingers respectively along the handles. The spring then resists abduction of the thumb and fingers from each other for exercise.

21 Claims, 1 Drawing Sheet

HAND EXERCISER

This application is a continuation of application Ser. No. 766,889, filed Aug. 16, 1985, now abandoned.

BACKGROUND OF THE INVENTION

The invention relates to a hand exerciser and, more particularly, a hand exerciser for abduction between the thumb and fingers of the hand.

Exercising a human hand has long been thought to have therapeutic value in speeding recovery from injury, for example, and beneficial value in improving performance on musical instruments such as the piano, in athletics, and in simply toning muscles of the body, for example. As a result, many hand exercisers are known.

Many of the hand exercisers, however, only exercise the muscles which contract the hand. One of the most familiar of these is a coil spring connected at opposite end portions to corresponding ends of a pair of generally-parallel handles. The handles are then pivoted about the spring coil which also exercisingly resists movement of the handles toward each other when the handles are grasped and squeezed together with a hand.

Such hand exercisers do not exercise the muscles which abduct the thumb and fingers from each other. Exercising abduction muscles may, however, be therapeutically beneficial as described in U.S. Pat. No. 4,455,019 issued June 19, 1984 to Harris or athletically beneficial as described in U.S. Pat. No. 4,105,200 issued Aug. 8, 1978 to Unger.

SUMMARY OF THE INVENTION

Accordingly, it is an object of the invention to provide a hand exerciser which exercises the muscles of the hand for abduction between the thumb and fingers.

To this and other ends, the invention provides a hand exerciser having a pair of generally-parallel handles pivotally connected at corresponding ends. The handles are resiliently urged together but spaced from each other sufficiently for engaging one handle with at least one (on a very strong individual) finger and the other handle with the thumb of a hand between the handles. Abduction of the thumb and fingers is then resisted by the resilient urging together of the handles to exercise the muscles of the hand which abduct the thumb and finger(s) from each other upon pushing the handles apart with the thumb and finger(s) therebetween preferably, of course, repeatedly.

In a preferred embodiment, the pivotal connection of the handles is made by a coil spring connected by opposite end portions to corresponding ends of the handles in substantial similarity to the above-described, known hand exerciser for exercising the muscles which contract the hand by gripping and squeezing the exerciser, except that the spring is arranged to urge the handles together instead of urging them apart as in the known exerciser. This similarity has substantial practical advantage in utilizing the manufacturing techniques of the known exerciser and in gaining market acceptance from the familiarity with the known exerciser. Because opposite, abduction muscles are exercised, however, the invention is complementary to and not redundant of the known exerciser.

In America's current fitness craze, there is a strong market for exercise devices. People are searching for improved ways of toning every body muscle. In this regard, exercise of the muscles which adbuct the thumb and fingers from each other exercises wrist, forearm and even upper arm muscles in addition to those more directly related to the thumb and fingers because of the complex anatomy of human hand musculature. This makes the invention particularly desirable and marketable for fitness use.

DESCRIPTION OF THE DRAWINGS

Other features of the invention will now be described with reference to a preferred embodiment which, however, illustrates but does not limit the invention, the merely-preferred embodiment being shown in drawings in which.

DESCRIPTION OF THE PREFERRED EMBODIMENT

Figure 1:
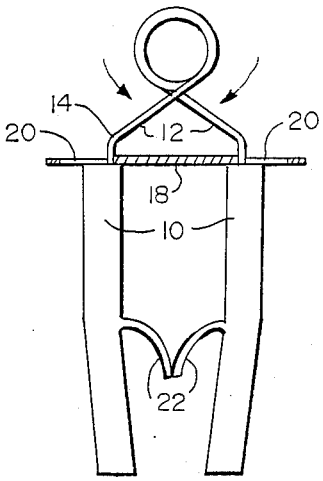
FIG. 1 is an elevation, partly in section, of the preferred embodiment.
Figure 4:
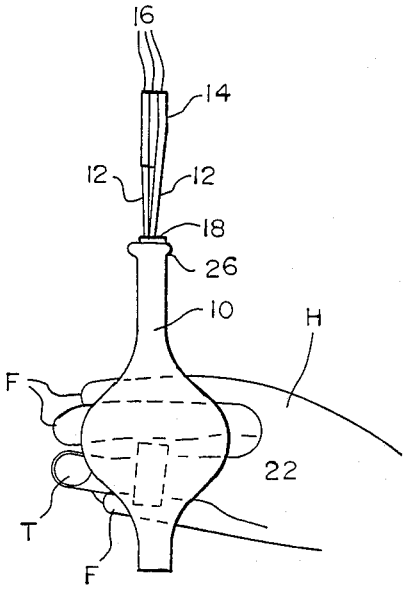
FIG. 4 is an end elevation of the preferred embodiment in conjunction with a hand for its use.

As shown in FIG. 1, the preferred embodiment has a pair of generally-parallel handles 10. Corresponding, top ends of the handles are connected to opposite end portions 12 of a spring wire 14 having at least one turn or coil 16, and preferably three as shown in FIG. 4, between the end portions. The spring wire 14 thus pivotally connect the handles. The spring wire 14 is also arranged by the tangents of the end portions to the coil to urge the handles 10 resiliently together as shown by the arrows and the position of the exerciser in FIG. 1.

In order, therefore, to provide space between the handles for a hand to engage the facing sides of the handles with, respectively, at least one finger and the thumb of the hand for exercising the muscles of the hand upon abduction of the thumb and finger from each other against the resilient urging of the spring wire 14 by pivoting the handles apart therewith, the handles 10 must be spaced apart. For this, a plate 18 has a pair of slots 20 spaced from each other and extending in the direction the handles can be pivoted about the coil 16 of the spring wire. The end portions 12 of the spring wire respectively extend through the slots. The spring wire therefore urges the handles together until the end portions 12 of the spring wire engage the facing ends of the slots 20 to space the handles correspondingly. The opposite ends of the slots 20 correspondingly delimit pivotal movement of the handles away from each other and the sides of the slots guide the pivotal movement.

Projections 22 are positioned along the handles for positioning the thumb and fingers along the handles. The projections also prevent slippage, i.e. provide a better grip. As a result, the projections 22 are intermediate the ends of the handles.

The projections 22 each curve away from the pivoted, corresponding ends of the handles connected to the spring wire 14. This provides hooks under which a thumb and finger respectively engage the handles to prevent them from slipping along the handles, particularly while manipulating the exerciser. This concentrates the effort of using the exerciser on the muscles intended. Because the thumb and finger(s) are hooked under the projections, the projections may also be made somewhat malleable to adjust to individual thumb and finger sizes.

Positioning the projections 22 intermediate the ends of the handles also allows one or more fingers to be positioned above the projection from the handle engaged by another finger(s), toward the pivoted, corresponding ends of the handles. This varies the orientation of the hand relative to the thumb so that various muscles are exercised more upon abducting the thumb and fingers from each other. It also varies the muscle strength available for abducting the handles to vary correspondingly the difficulty of the exercise and adapts the device for the different sizes of users' hands.

Figure 2:
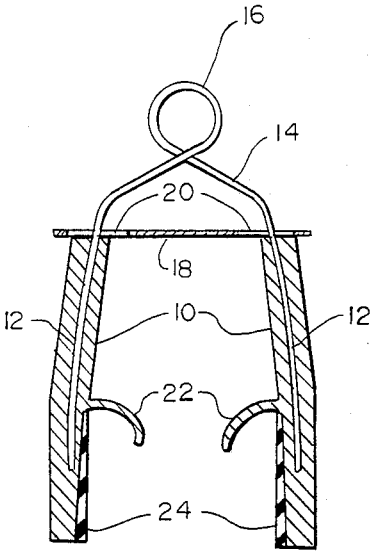
FIG. 2 is an elevation, partly in section, of the preferred embodiment in a different, expanded position.
Figure 3:
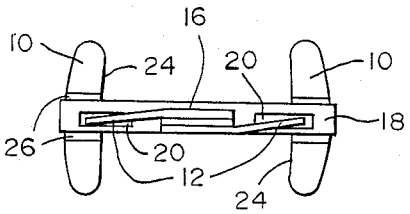
FIG. 3 is a plan view of the preferred embodiment as shown in FIG. 2.

FIGS. 2 and 3 show the preferred embodiment in the position it will have upon abducting the thumb and finger(s) of a hand between the handles. FIG. 2 further shows that the end portions 12 of the spring wire 14 preferably extend into the handles 10 past the projections 22. This relieves unnecessary stress between the spring wire 14 and handles 10 so that, again, less and less-expensive materials may be used.

FIG. 2 also shows that at least the portion of the handles 10 between the projections 22 and the ends of the handles opposite those from which the end portions 12 of the spring wire project are cushioned with an inset resilient material 24 to cushion the thumb and finger engaged with the handles below the projections 22 upon their abduction. Repetition is, of course, an important element in the use of the exerciser and, therefore, the cushioning is important. The projections 22 again cooperate with another feature of the invention, in this case the cushioning of resilient material 24, by locating the thumb and one or more fingers engaged with the handles therebelow so that only that portion of the handles needs to be cushioned. Again, this allows less cushioning material to be used and less-expensive, non-resilient material to be used for the remainder of the handles. Of course, however, if it were desired, all of the handles could be made from a material which had sufficient strength and, for cushioning, sufficient resilience or no resilience for no cushioning in other embodiments (not shown) of the invention. In still another embodiment (not shown), the resilient material 24 may be replaced by a fabric-covered wire mesh which may or may not have some resilience but which at least temporarily deforms to conform to a particular users hand at least after several, immediately-successive pivotal movements of the handles.

FIGS. 3 and 4 show that the handles 10 are amphora-shaped laterally of the direction in which the handles pivot about spring coil 16 to be broadened about the projections 22. This cooperates with the projections and the resilient material 24 in providing sufficient surface and curved contour for comfortable engagement by the thumb T and fingers F of a hand H as shown in FIG. 4.

FIGS. 3 and 4 also show an amphora-like enlargement 26 on the corresponding ends of the handles from which the end portions 12 of the spring wire 14 project. This cooperates with the plate 18 and its slots 20 in that the plate may be loose, i.e. not connected to either the handles 10 or spring wire 14, and the slots 20 sufficiently wider than the spring wire 14 to avoid binding it while, at the same time, not binding the handles 10 or spring wire 14 with the plate 18 if the plate tilts relative thereto as a result of its loose connection. The enlargement 26 therefore provides a guiding function.

All of the components of the preferred embodiment of the exerciser now described are symmetric with respect to an axis through the center of coil 16 and between the handles 10. As a result, the exerciser may be used by either a right or left hand. The symmetry also standardizes the handles for easier manufacture.

In use, as shown in FIG. 4, therefore, the thumb T of a hand H, in this case a right hand, is hooked under the curve of one projection 22 and the two smallest fingers F (only one shown—other is hidden) of the hand are hooked under the curve of the projection (not shown) on the other handle. The two larger fingers of the hand are above the projections so that, in this case, the muscles being exercised are those which abduct the thumb from the central plane of the hand. As described above, however, user may vary the number of fingers above or below the projection to adapt the device to his needs (i.e.—hand size, strength, torque length).

In other uses of the exerciser, a different number or no fingers may be above the projections 22. This differently orients the hand so that different muscles are emphasized in abducting the thumb and fingers. It is also possible, of course, to place one or more fingers on the outside of the handle engaged thereby, away from the other handle, so that such finger(s) is not involved in the exercise.

In any of these arrangements of the hand in the exerciser, the exercise is provided by moving the handles away from each other against the resilience of the coil 16 of the spring wire 14 which urges the handles together. The muscles exercised are, therefore, those for abducting the thumb and fingers from each other.

It will be understood that the specification and examples are illustrative but not limitative of the present invention and that other embodiments within the spirit and scope of the invention will suggest themselves to those skilled in the art.

I claim:

1. A hand exerciser comprising:

a pair of substantially parallel handles;

spring means for pivotally connecting corresponding ends of the handles and for resiliently urging the handles pivotally together;

spacing means disposed between said spring means for spacing apart the urged together handles from each other positioning means having at least one projection disposed on each of the handles, the projection on one handle being engaged with at least one finger of a hand and the projection on the other handle being engaged with the thumb of the hand to overcome the resilient urging of the handles together by the spring means and to pivot the handles apart upon abduction of the finger and thumb of one hand for exercising hand, wrist and arm muscles.

2. A hand exerciser according to claim 1 wherein the one projection disposed on each of the handles is positioned intermediate the ends of the handles and curves away from a facing side of the handles forming hooks for engaging the thumb and finger of the hand.

3. The hand exerciser of claim 1, wherein the spring means comprises a spring wire having opposite end portions extending from the corresponding ends of the handles and having at least one turn in the spring wire between the end portions of the spring wire for urging the handles together.

4. The hand exerciser of claim 3, wherein the spacing means comprises a plate having slots extending in the pivotal direction of the handles for respectively receiving the end portions of the spring wire, the slots having ends spaced from each other for engaging the end portions of the spring wire when the handles are pivoted together.

5. A hand exerciser, comprising:

a pair of generally-parallel handles;

spring means for pivotally connecting corresponding ends of the handles and or resiliently urging the handles pivotally together, whereby the spring means opposes pivoting the handles apart upon abduction of the thumb and finger of one hand for exercising hand, wrist and arm muscles, the spring means comprising a spring wire having opposite end portions extending from the corresponding ends of the handles and having at least one turn in the spring wire between the end portions of the spring wire for urging the handles together; and spacing means spacing apart the urged-together handles from each other for engaging therebetween one handle with at least one finger of a hand and the other handle with the thumb of the hand, the spacing means comprising a plate having slots extending in the pivotal direction of the handles for respectively receiving the end portions of the spring wire, the slots having ends spaced from each other for engaging the end portions of the spring wire when the handles are pivoted together.

6. The hand exerciser of claim 5, wherein the other ends of the slots comprise means for limiting movement of the handles away from each other and the sides of the slots comprise means for guiding the pivotal motion.

7. The hand exerciser of claim 5, wherein each handle has a side facing the other handle, and further comprising a projection from the side of each handle facing the other handle for positioning the thumb and fingers therealong.

8. The hand exerciser of claim 7, further comprising means for cushioning at least a portion of the facing side of each handle, the portion extending from the projection toward the ends of the handles opposite the corresponding ends connected to the spring means.

9. The hand exerciser of claim 7, wherein the projections curve to protect away from the corresponding ends of the handles connected by the spring means.

10. The hand exerciser of claim 9, wherein the projections are intermediate the ends of the handles relative to each other for receiving at least one finger on each side of one when the thumb engages the other on the side thereof opposite the corresponding ends of the handles connected to the spring means.

11. The hand exerciser of claim 7, wherein the projections are intermediate the ends of the handles relative to each other for receiving at least one finger on each side of one when the thumb engages the other on the side thereof opposite the corresponding ends of the handles connected to the spring means.

12. The hand exerciser of claim 5, wherein each handle has a side facing the other handle, and further comprising a projection from the side of each handle facing the other handle for positioning the thumb and fingers therealong.

13. The hand exerciser of claim 12, wherein the projections curve to protect away from the corresponding ends of the handles connected by the spring means.

14. The hand exerciser of claim 13 wherein the projections are intermediate the ends of the handles relative to each other for receiving at least one finger on each side of one when the thumb engages the other on the side thereof opposite the corresponding ends of the handles connected to the spring means.

15. The hand exerciser of claim 5, wherein each handle has a side facing the other handle, and further comprising a projection from the side of each handle facing the other handle for positioning the thumb and fingers therealong.

16. The hand exerciser of claim 15, wherein the projections curve to protect away from the corresponding ends of the handles connected by the spring means.

17. The hand exerciser of claim 16, wherein the projections are intermediate the ends of the handles relative to each other for receiving at least one finger on each side of one when the thumb engages the other on the side thereof opposite the corresponding ends of the handles connected to the spring means.

18. The hand exerciser of claim 17, further comprising means for cushioning at least a portion of the facing side of each handle, the portion extending from the projection toward the ends of the handles opposite the corresponding ends connected to the spring means.

19. The hand exerciser of claim 5, wherein each handle has a side facing the other handle and further comprising means for cushioning at least a portion of the facing side of each handle.

20. A hand exerciser, comprising:

a pair of generally-parallel handles;

a spring wire having opposite end portions extending, respectively, from corresponding ends of the handles and at least one turn between the end portions for urging the handles together pivotally;

spacing means for spacing apart the urged-together handles from each other, whereby to engage therebetween one handle with at least one finger of a hand and the other handle with the thumb of the hand, the spacing means comprising a plate having slots respectively receiving the end portions of the spring wire and extending in the pivoting direction, the slots having ends spaced from each other for engaging the end portions of the spring wire when the handles are pivoted together; and positioning means comprising a projection intermediate the ends of each handle for positioning the thumb and finger along the handles.

21. A hand exerciser comprising:

a pair of substantially parallel handles;

spring means for privotally connecting corresponding ends of the handles and for resiliently urging the handles pivotally together;

spacing means disposed on said handles for spacing apart the urged together handles from each other; and positioning means having at least one projection disposed on each of the handles, the projection on one handle being engaged with the thumb of the hand to overcome the resilient urging of the handles together by the spring means and to pivot the handles apart upon abduction of the finger and thumb of one hand for exercising hand, wrist and arm muscles.

* * * * *

UNITED STATES PATENT AND TRADEMARK OFFICE

CERTIFICATE OF CORRECTION

PATENT NO. : 4,763,896

DATED : August 16, 1988

INVENTOR(S) : Fred Press

It is certified that error appears in the above-identified patent and that said Letters Patent is hereby corrected as shown below:

Column 5, line 47, "protect" should be --project--.

Column 6, line 2, "protect" should be --project--.

Column 6, line 16, "protect" should be --project--.

Signed and Sealed this

Twenty-first Day of November, 1989

*Attest:*

JEFFREY M. SAMUELS

*Attesting Officer*

*Acting Commissioner of Patents and Trademarks*